US006848128B2

(12) United States Patent
Verbovszky et al.

(10) Patent No.: US 6,848,128 B2
(45) Date of Patent: Feb. 1, 2005

(54) PORTABLE INFANT CUSHION

(75) Inventors: Esther A. L. Verbovszky, 325 N. Falmouth Dr., Rocky River, OH (US) 44116; Carl J. Myers, Mentor, OH (US)

(73) Assignee: Esther A. L. Verbovszky, Rocky River, OH (US)

( * ) Notice: Subject to any disclaimer, the term of this patent is extended or adjusted under 35 U.S.C. 154(b) by 58 days.

(21) Appl. No.: 10/120,089

(22) Filed: Apr. 10, 2002

(65) Prior Publication Data

US 2003/0192119 A1 Oct. 16, 2003

(51) Int. Cl.[7] ..... A47D 13/06

(52) U.S. Cl. ..... 5/93.1; 5/94; 5/98.1; 5/101; 5/655; 5/945

(58) Field of Search ..... 5/93, 94, 98.1, 5/99.1, 100, 101, 655, 494, 692, 732, 945, 93.1

(56) References Cited

U.S. PATENT DOCUMENTS 2,626,407 A * 1/1953 Kurry ..... 5/99.1
3,321,779 A * 5/1967 Kaufman et al. ..... 5/93.1
3,803,646 A * 4/1974 Newerowski ..... 5/496
4,583,253 A * 4/1986 Hall ..... 5/94
4,788,726 A * 12/1988 Rafalko ..... 5/93.1
5,014,376 A * 5/1991 Doran et al. ..... 5/603
5,153,954 A * 10/1992 Ohman ..... 5/93.1
5,341,530 A * 8/1994 Ward ..... 5/93.1
5,345,622 A * 9/1994 Plone ..... 4/588
5,551,108 A * 9/1996 Butler, III ..... 5/655
5,561,876 A * 10/1996 Petruzella ..... 5/724
5,699,569 A * 12/1997 Schwarz-Zohrer ..... 5/655
5,937,465 A * 8/1999 Carew et al. ..... 5/732
6,026,525 A * 2/2000 Davis ..... 5/99.1
6,370,715 B1 4/2002 Morton
6,446,290 B1 * 9/2002 Gidtske ..... 5/725
6,490,741 B1 * 12/2002 Wheeler ..... 5/494
6,505,366 B1 * 1/2003 Lied ..... 5/655

* cited by examiner

*Primary Examiner*—Teri Pham Luu
(74) *Attorney, Agent, or Firm*—Tarolli, Sundheim, Covell & Tummino L.L.P.

(57) ABSTRACT

A portable infant cushion (10) includes a base (12) having a top surface (14) for engaging the body of an infant placed onto the top surface and for transferring the weight of the infant. The top surface (14) includes a head support portion (20) non-releasably attached to the base (12) and having a head engaging surface elevated relative to the base for supporting the head of the infant. The top surface (14) includes a body support portion (18) connected to the base (12) which is longitudinally spaced from the head support (20) and is for supporting the body of an infant. A side wall (24) extends peripherally around the base (12) and having an elevated surface elevated higher than the head support (20). The cushion (10) includes a blanket (32) for covering the infant adapted to be placed on the top surface (14). The blanket (32) has at least a portion secured to the side wall (24). The blanket (32) is extensible over the top surface (14) without extending over the head support portion (20).

18 Claims, 7 Drawing Sheets

PORTABLE INFANT CUSHION

TECHNICAL FIELD

The present invention relates to a portable infant cushion, and particularly to a portable infant cushion with an integrated blanket and pillow.

BACKGROUND OF THE INVENTION

It is common for infants to sleep in cribs, bassinets, baby carriers, car seats, baby buggies or strollers. It is also common for infants to sleep with a pillow and a blanket. An infant's physical safety and emotional comfort while sleeping is of particular concern. The pillow and blanket are potentially harmful items to an infant while sleeping. The infant may unconsciously pull the blanket over his/her head or roll underneath the pillow and suffocate while sleeping.

Travelling with infants is often difficult because of the amount of accompanying paraphernalia that is required. In addition, many required items are used only for short periods of time since infants quickly outgrow these items. Infant gear which is adjustable in size in response to the increasing growth of the infant as the infant ages retains usefulness longer and is a better investment for caregivers.

SUMMARY OF THE INVENTION

A portable infant cushion includes a base having a top surface for engaging the body of an infant placed onto the top surface and for transferring the weight of the infant. The top surface includes a head support portion non-releasably attached to the base and having a head engaging surface elevated relative to the base for supporting the head of the infant. The top surface includes a body support portion connected to the base and is longitudinally spaced from the head support for supporting the body of an infant. A side wall extends peripherally around the base and has an elevated surface elevated higher than the head support.

The cushion includes a blanket for covering the infant adapted to be placed on the top surface. The blanket has at least a portion secured to the side wall. The blanket extends over the top surface without extending over the head support portion.

BRIEF DESCRIPTION OF THE DRAWINGS

The foregoing and other features of the present invention will become apparent to those skilled in the art to which the present invention relates upon reading the following description with reference to the accompanying drawings, in which.

DETAILED DESCRIPTION OF THE INVENTION

Figure 1:
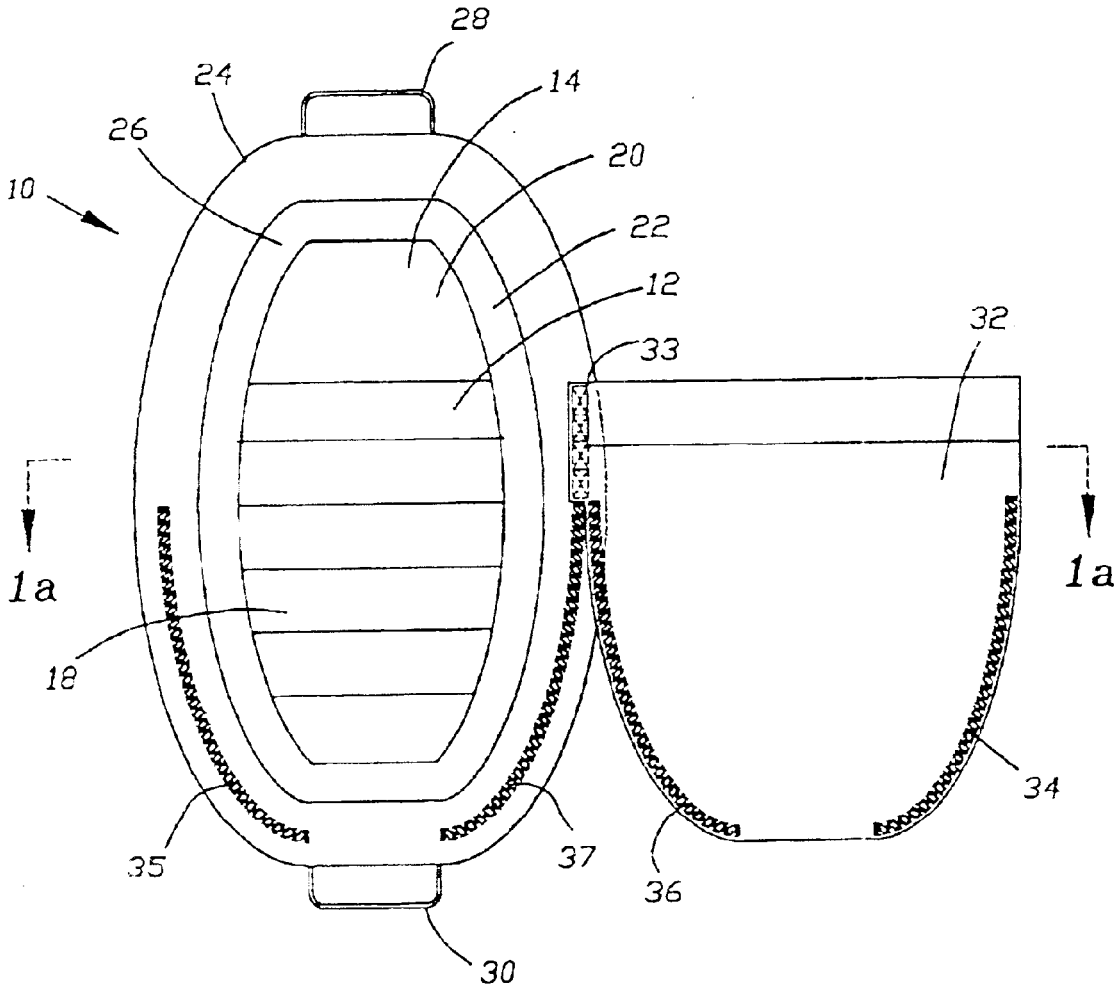
FIG. 1 is a schematic plan view of a portable infant cushion embodying the present invention.
Figure 1A:
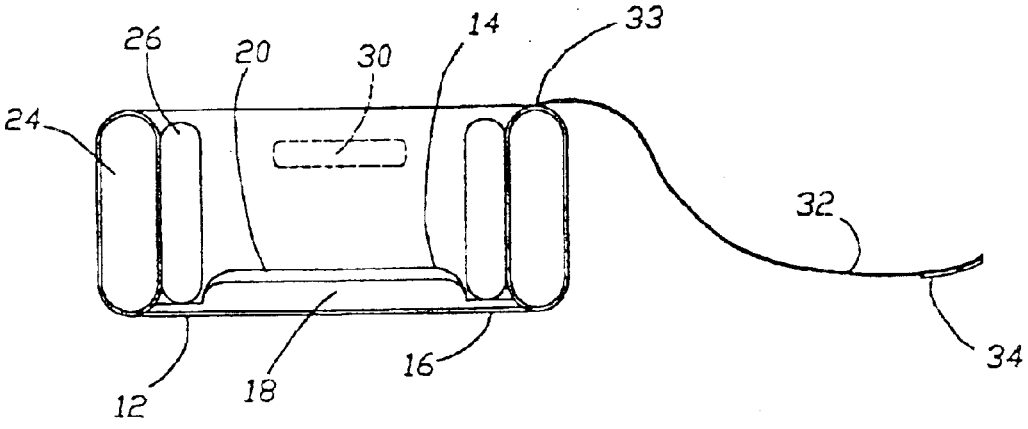
FIG. 1*a* is a side view of the portable infant cushion of FIG. 1.

The present invention relates to a portable infant cushion. The infant cushion 10 is illustrated in FIGS. 1–1*a*. The infant cushion 10 has a generally oval shape. The infant cushion 10 also has a planar base 12 made of a thin layer of cushion material. The base 12 has a top surface 14 for engaging and supporting an infant placed onto the cushion 10. The base 12 also has a bottom surface 16 opposite the top surface. The base 12 is a resilient structure preferably made of a French terry cloth material filled with batting. Specifically, the base 12 is a thin layer of batting between two layers of French terry cloth material. French terry cloth consists of 80% cotton/20% polyester fiber. The batting is preferably a flame retardant 100% polyester material.

A body support 18 is secured to the top surface 14 of the base 12. The body support 18 is a separate structure which is a layer of batting between two layers of French terry cloth material. The body support 18 is sewn onto the top surface 14 of the base 12. Several sew lines are schematically illustrated on the body support 18 in FIG. 1. The sew lines extend transverse to a longitudinal direction of the cushion 10. The body support 18 has a surface which is elevated higher than the top surface 14 of the base 12. The body support 18 is a half-oval shape.

A head support or pillow 20 is sewn to the top surface 14 of the base 12 adjacent the body support 18. The pillow 20 is also a separate structure and is made of several layers of batting between two layers of French terry cloth material. The pillow 20 has a surface which is elevated higher than the surface of the body support 18. The pillow 20 and body support 18 are for supporting the head and body of an infant lying supine on the cushion 10. The pillow 20 and the body support 18 are integral with the base 12.

The pillow 20, body support 18, and base 12 are preferably made of French terry cloth material filled with batting. Instead of French terry cloth, the material of the pillow 20 and the body support 18 may be any suitable equivalent textile material such as cotton, polyester, wool, fleece, or a combination thereof. Instead of batting, the pillow 20 and body support 18 can be filled with foam or gel or other suitable material or can be inflated with water or air. The material of the body support 18 and the pillow 20 may also be made of a cushioning media such as a flame retardant foam rubber or foam vinyl covered with a suitable washable skin made of hypoallergenic plastic, nylon, polyurethane or any suitable material. The cushioning media may have skin manufactured with a nylon facing and a backing of a 65%/35% combination of polyester and cotton. The foam used in the manufacture of the pillow 20 and the body support 18 can also be a particular type of foam known as "memory foam". Memory foam retains the shape of an object which is pressed onto it. For example, memory foam can retain the body shape of a premature infant who is placed on the foam. The entire infant cushion 10 is washable.

The base 12 includes an area which defines a boundary 22 around the body support 18 and pillow 20. A side wall 24 is attached to the periphery of the base 12 at the boundary 22. The side wall 24 has a surface which is elevated higher than the surface of the pillow 20 and the body support 18. The boundary 22 extends between both the side wall 24 and the body support 18 as well as the side wall 24 and the pillow 20. The side wall 24 is a unitary tube-shaped cushion having a ring structure and which is attached to the periphery of the base 12 by sewing. Instead of attaching the side wall 24 to the base 12 by sewing, the side wall 24 can alternatively be attached to the base by fasteners such as snaps, buttons, zippers, hooks, glue etc.

Figure 4:
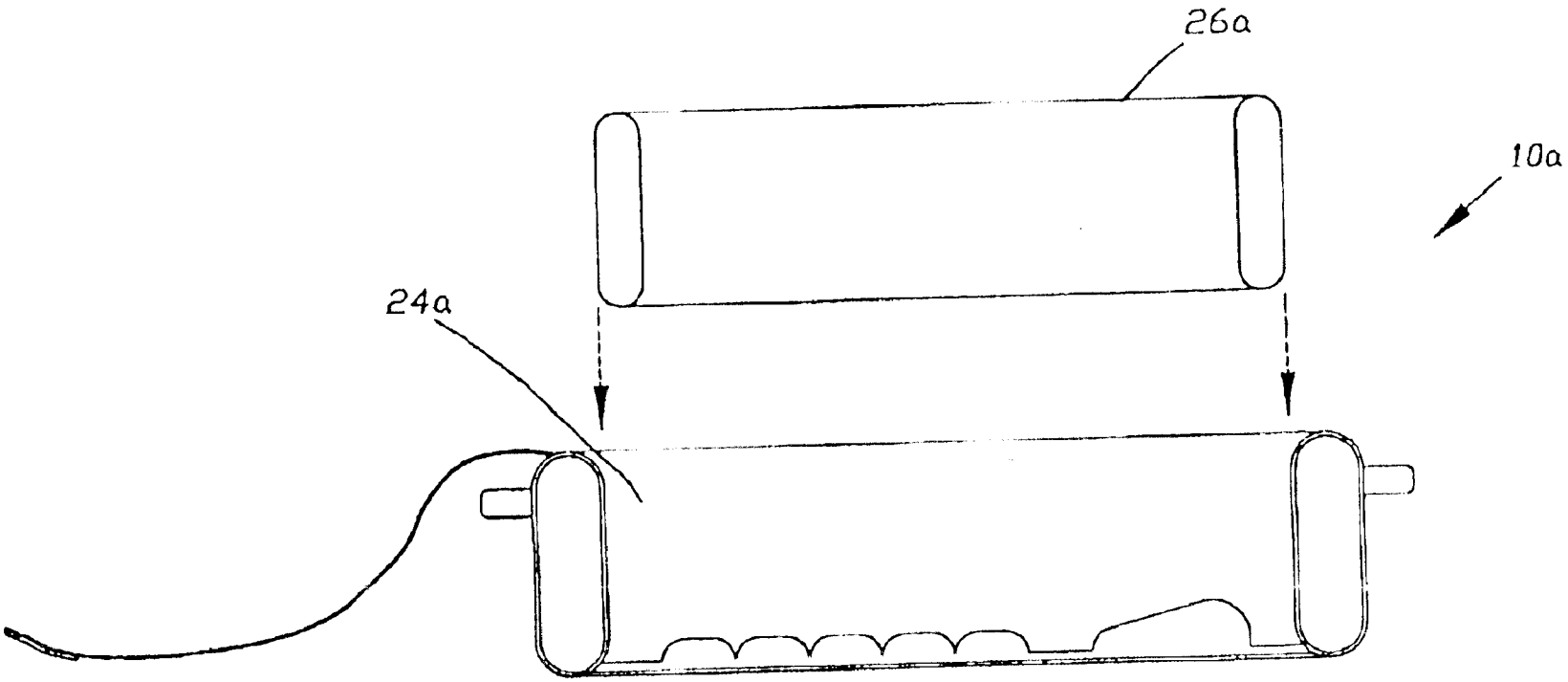
FIG. 4 is an exploded view of the portable infant cushion of FIG. 2*a;*

A removable ring-shaped cushion insert 26 is for location on the boundary 22. The ring insert 26 is a separate structure identical to the side wall 24. The ring insert 26 is an unitary tube-shaped cushion having a ring structure. The ring insert 26 is optionally inserted into the cushion 10 onto the boundary 22 on the base 12 between the side wall 24 and the body support 18 and pillow 20 (FIG. 4). The ring insert 26 is removable.

Both the side wall 26 and the ring insert 26 are preferably made of a tube of French terry cloth material filled with batting. Instead of French terry cloth, the material of the base 12, the side wall 24 and the ring insert 26 may be any suitable equivalent textile material such as cotton, polyester, wool, fleece, or a combination thereof. Also, the batting may be of a suitable material other than polyester materials.

The ring insert 26, when placed on the boundary 22, reduces the surface area of the base 12 on which the infant can lie and provides an additional wall of cushion material. The purpose of the ring insert 26 is to make the cushion 10 adjustable with the growth of the infant. If desired, the ring insert 26 can be placed onto the boundary 22 on the base 12 when the infant is smaller in size, for example, when the infant is a new born or an infant who is born premature. Similarly, when the infant grows to a larger size, the ring insert 26 can be removed from the cushion 10 which increases the surface area upon which the infant can lie. Thus, the cushion 10 can comfortably accommodate a smaller size infant as well as a larger size infant.

A pair of handles 28, 30 (FIG. 1) are non-releasably attached to the side wall 24 at opposite ends of the cushion 10. The handles 28, 30 are for transporting the cushion 10. In the embodiment according to FIG. 1, one handle 28 is located on the side wall 24 adjacent the pillow 20 and the other handle 30 is located on the side wall 24 adjacent the body support 18 where the infant's feet would be located.

In the embodiments, according to FIGS. 1–4, a blanket 32 is integrated with the cushion 10 by sewing a portion of the blanket to the side wall 24. This portion of the blanket 32 (indicated at reference number 33) is non-releasably attached to the side wall 24.

Portions 34, 36 of the blanket 32 are also releasably secured to portions 35, 37 of the side wall 34. The blanket 32 and the side wall 24 are provided with Velcro™ at specific mating portions 34, 35 and 36, 37 to releasably secure these portions together (FIG. 1). The blanket 32 has a half-oval shape and corresponds to the oval shape of the cushion.

The blanket 32 is preferably made of French terry cloth material. However, the blanket can be made of fleece or other similar material. The blanket 32 extends across the body support 18 up to the pillow 20 but does not extend over the pillow. The blanket 32 additionally does not extend over the head of the infant when the infant is placed onto the cushion 10. Furthermore, the infant cannot pull the blanket 32 up over his/her head since it is secured to the side wall 24 by the Velcro™. Instead of Velcro™, the blanket 32 and the side wall 24 can be releasably secured together by, for example, snaps, clips, catches, hook and eye closures, buttons and zippers.

In the embodiment according to FIG. 1, the cushion 10 is approximately 4 inches in total height, 15 inches in total width and 30 inches in total length. The side wall 24 is approximately 4 inches in height and 2 inches think. The height and thickness of the side wall 24 and the insert ring 26 are equal (FIG. 4). The height of the pillow 20 is five times the thickness of the base 12. The thickness of the body support 18 is twice the thickness of the base 12. It is to be understood that various dimensions can be used according to the desire of the manufacturer for different size infants. For example, the cushion 10 can range in total height from approximately 3.5–4 inches in total height, 12–15 inches in total width and 23–30 inches in total length. The side wall 24 can range in height from approximately 3.5–4 inches and can range in thickness from 2–3.5 inches. The height and thickness of the side wall 24 and the ring insert 26 also can be unequal.

Figure 3:
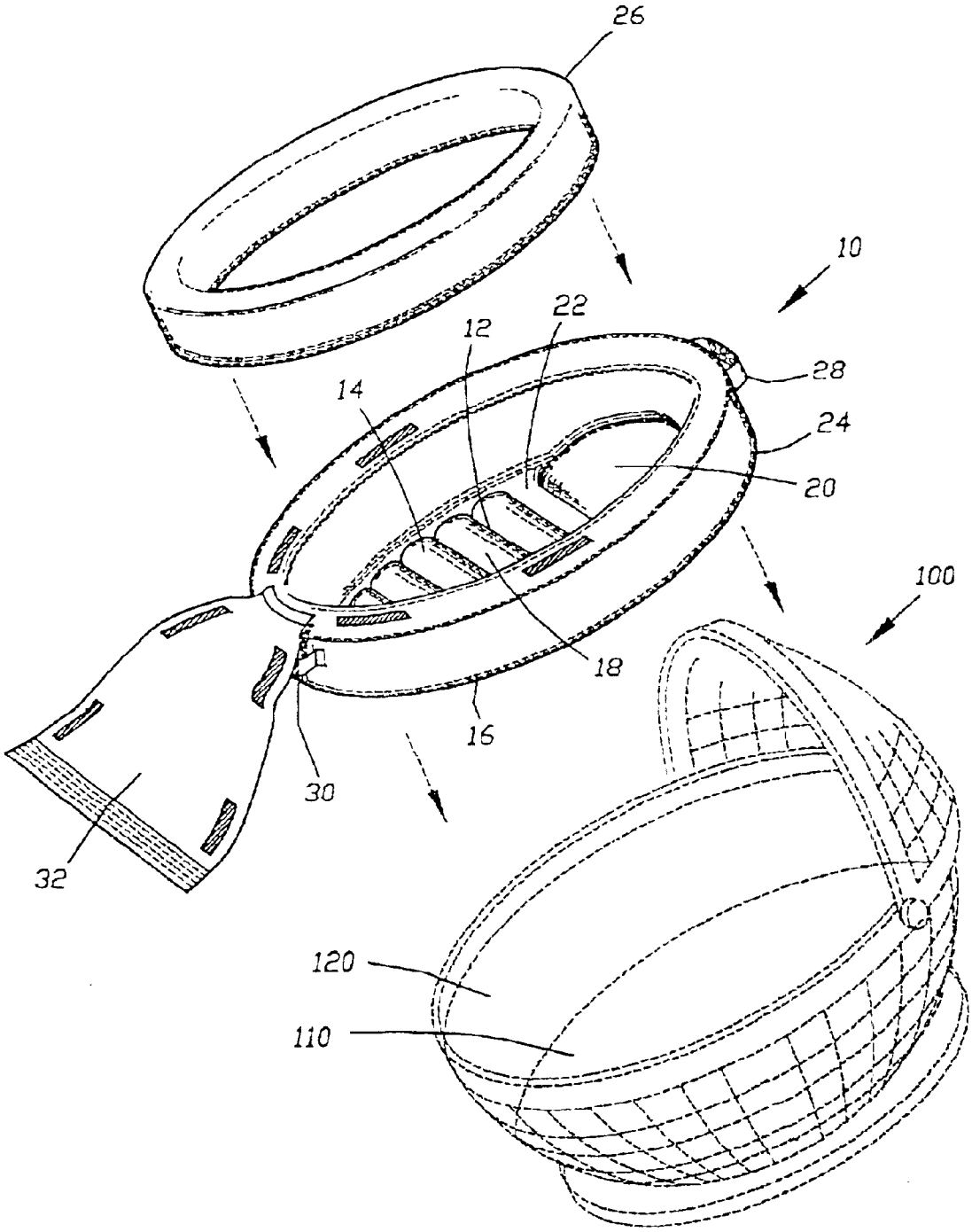
FIG. 3 is a schematic exploded view of the portable infant cushion of FIG. 1 illustrated with a schematic illustration of a baby bassinet.

FIG. 3 illustrates an exploded view of the portable infant cushion 10 according to FIG. 1 and the removable ring insert 26 for insertion into a bassinet 100. The bassinet 100 is illustrated in a schematic view and can have any similar construction. The bassinet 100 does not form any part of the invention. The bassinet 100 includes a flat bed portion 110 and a barrier portion 120 extending upwardly from the perimeter of the bed portion.

Upon assembly, if desired, the ring insert 26 is first inserted into the cushion 10. The cushion 10 is then inserted into the bassinet 100 so that the bottom surface 16 of the base 12 of the cushion 10 engages the bed portion 110 of the bassinet 100 and an outer surface of the side wall 24 of the cushion 10 engages the barrier portion 120 of the bassinet. An infant (not shown) is then placed supine into the portable infant cushion 10 so that the head of the infant rests on the pillow 20 and the body of the infant rests on the body support 18. Finally, the blanket 32 is releasably attached to the side wall 24 via Velcro™. The side wall 24 and the ring insert 26 extend around the infant at a height which is higher than the infant to prevent the infant from rolling over the side wall 24 and out of the cushion 10.

The cushion 10 advantageously reduces the space available inside the bassinet 100 for placement of an infant. The cushion 10 additionally provides a more comfortable and more cushioned sleeping environment for an infant than the bassinet 100 by itself. Also, if the ring insert 26 is inserted into the cushion 10, the top surface area 14 of the cushion is advantageously reduced even more to accommodate a smaller size infant.

Figure 2:
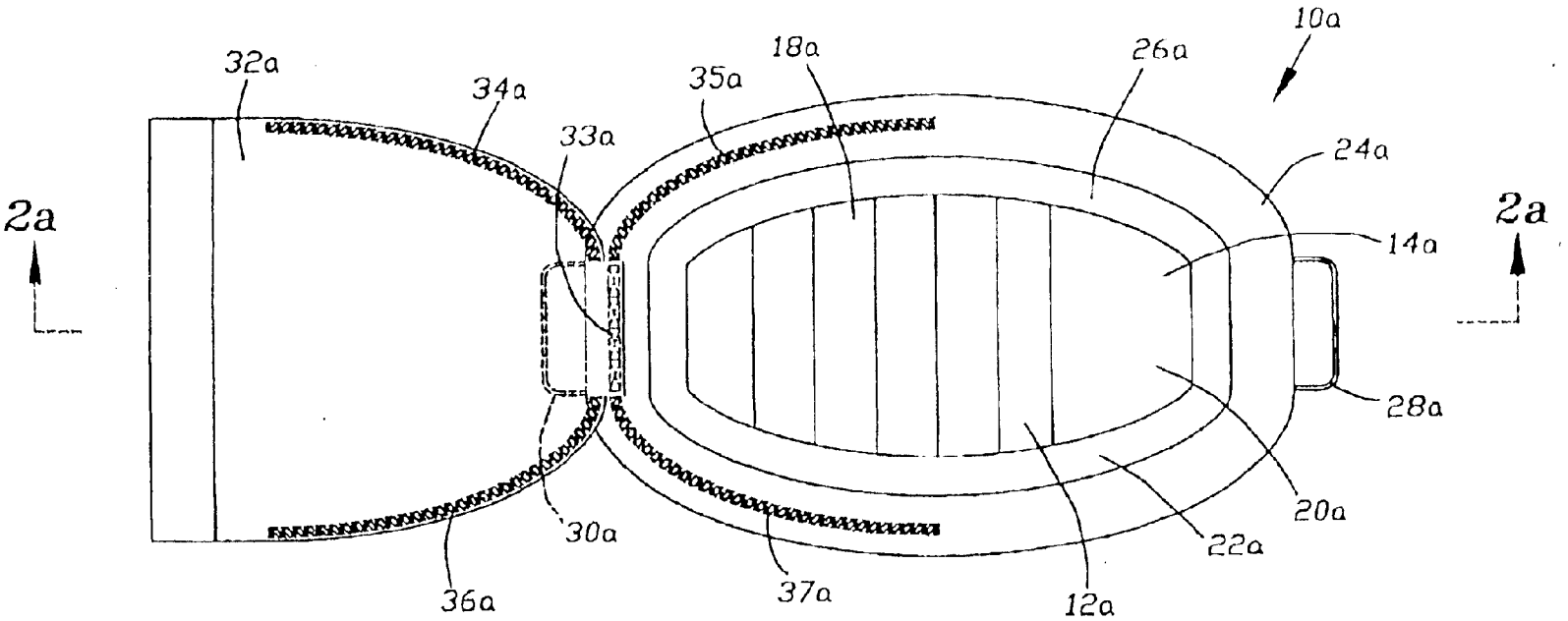
FIG. 2 is a schematic plan view of a portable infant cushion according to a second embodiment.
Figure 2A:
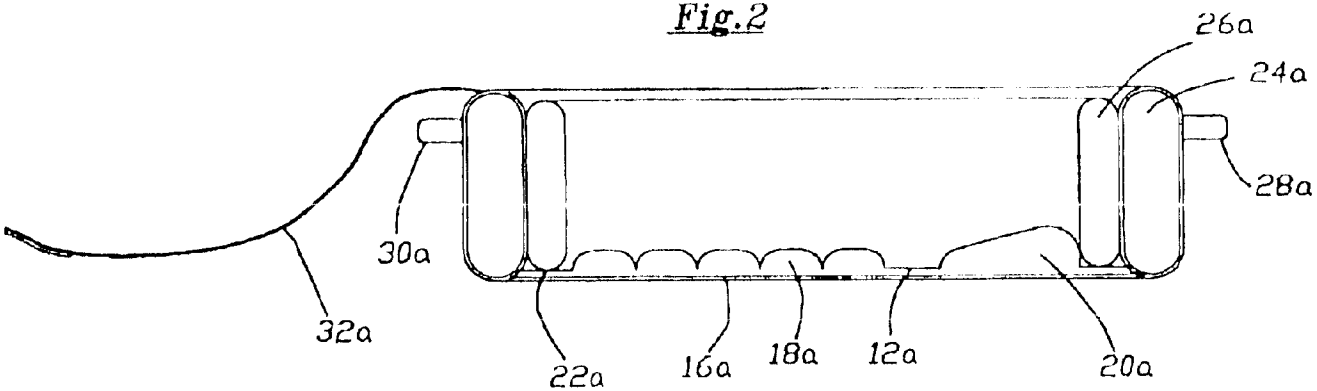
FIG. 2*a* is a cross-sectional view of the portable infant cushion taken along the lines 2*a*—2*a* of FIG. 2.

FIGS. 2–2*a* illustrate a second embodiment of the portable infant cushion. The cushion 10*a* is similar to the cushion 10 and parts that are the same or similar are given the same reference numerals with the suffix "a" attached. The infant cushion 10*a* has a generally oval shape. The infant cushion 10*a* also has a planar base 12*a* made of a thin layer of cushion material. The base 12*a* has a top surface 14*a* for engaging and supporting an infant placed onto the cushion and an opposing bottom surface 16*a*.

A body support 18*a* is secured to the top surface 14*a* of the base 12*a*. A head support or pillow 20*a* is secured to the top surface 14*a* of the base 12*a*. The pillow 20*a* has a surface which is elevated higher than the body support 18*a*. The pillow 20*a* and the body support 18*a* are for supporting the head and body of an infant lying supine on the cushion 10*a*.

The base 12*a* includes an area which defines a boundary 22*a* around the body support 18*a* and the pillow 20*a*. A side wall 24*a* is attached to the periphery of the base 12*a* at the boundary 22*a*. The side wall 24*a* is a tube-shaped cushion. The side wall 24*a* has a surface which is elevated higher than the pillow 20*a* and the body support 18*a*. The boundary 22*a* extends between the side wall 24*a* and the body support 18*a* and between the side wall 24*a* and the pillow 20*a*.

A removable ring-shaped cushion insert 26*a* is for location on the boundary 22*a*. The ring insert 26*a* is identical to the side wall 24*a*. The ring insert 26*a*, when placed on the boundary 22*a*, reduces the surface area of the base 12*a* on which the infant can lie (FIG. 2*a*).

A pair of handles 28*a*, 30*a* are non-releasably attached to the side wall 24*a* at opposite ends of the cushion 10*a*. The handles 28*a*, 30*a* are for transporting the cushion 10*a*. In the embodiment according to FIG. 1, one handle 28*a* is located on the side wall 24*a* adjacent the pillow 20*a* and the other handle 30*a* is located on the side wall 24*a* adjacent the body support 18*a* where the infant's feet would be located.

Similar to the embodiment shown in FIGS. 1–1*a*, the embodiment in FIGS. 2–2*a*, show a portion of the blanket 32*a* (illustrated at reference number 33*a*) which is non-releasably attached to the side wall 24*a*. However, an alternate location where the blanket 32*a* is attached to the side wall 24*a* is shown. The blanket 32*a* is sewn to the side wall 24*a* in the region located adjacent where the infant's feet would be located. The blanket 32*a* is non-releasably secured to the side wall 24*a* at the sewn portion.

Portions 34*a*, 36*a* of the blanket 32*a* are also releasably secured to portions 35*a*, 37*a* of the side wall 24*a*. Instead of Velcro™ shown in FIGS. 1–1*a*, the blanket 32*a* shown in FIGS. 2–2*a* is releasably secured to the side wall 24*a* by a zipper. The blanket 32*a* and the side wall 24*a* are provided with the zipper at specific mating portions to releasably secure these portions together (FIG. 2).

Similar to the embodiment shown in FIG. 1, the embodiment in FIGS. 2–2*a* show the blanket 32*a* extending across the body support 18*a* up to the pillow 20*a* but the blanket does not extend over the pillow nor the head of the infant when the infant is placed into the cushion 10*a* and covered by the blanket. The infant cannot pull the blanket 32*a* up over his/her head since it is secured to the side wall 24*a* by the zipper.

Figure 5:
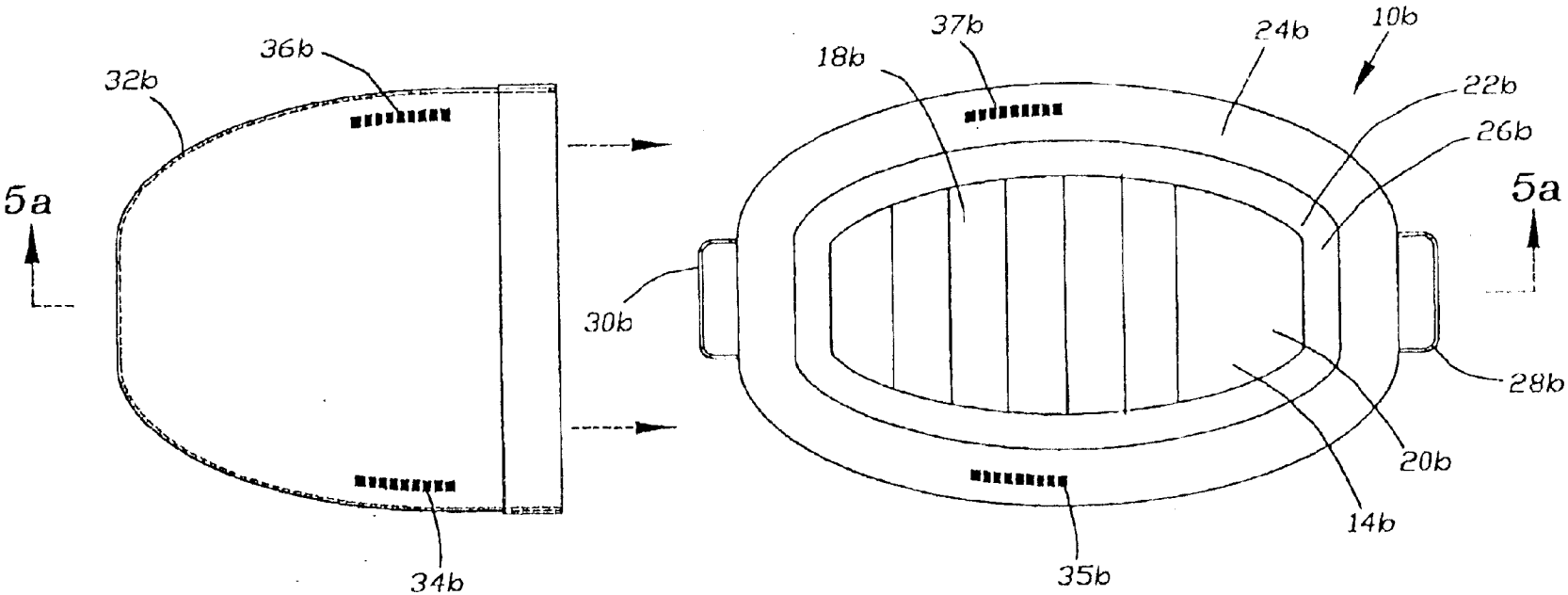
FIG. 5 is a schematic plan view of the portable infant cushion according to a third embodiment.
Figure 5A:
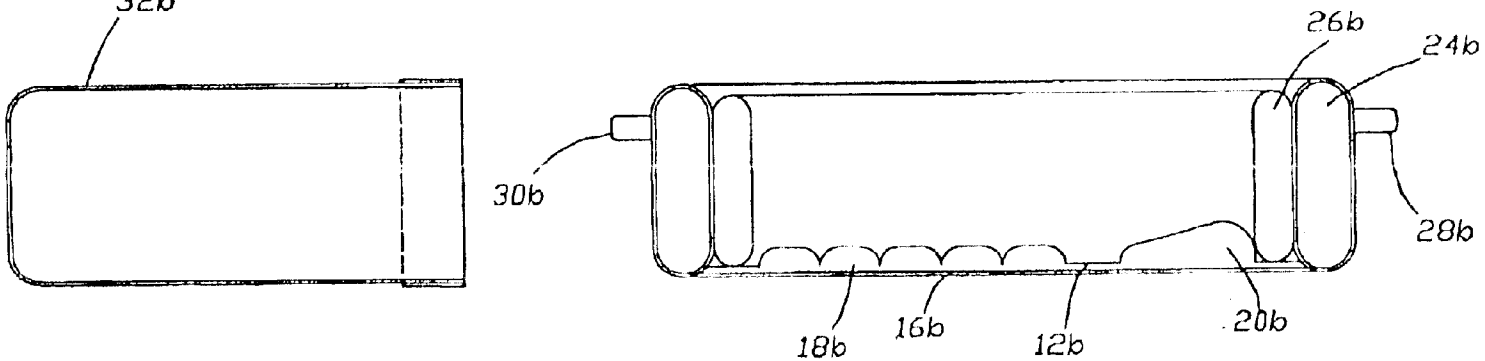
FIG. 5*a* is a cross-sectional view of the portable infant cushion taken along the lines 5*a*—5*a* of FIG. 5.

FIGS. 5–5*a* illustrate a third embodiment of the portable infant cushion. The cushion 10*b* is similar to the cushion 10, and parts that are the same or similar are given the same reference numerals with the suffix "b" attached. The infant cushion 10*b* has a generally oval shape. The infant cushion 10*b* also has a planar base 12*b* made of a thin layer of cushion material. The base 12*b* has a top surface 14*b* for engaging and supporting an infant placed onto the cushion 10*b* and an opposing bottom surface 16*b*.

A body support 18*b* is secured to the top surface 14*b* of the base 12*b*. A head support or pillow 20*b* is secured to the top surface 14*b* of the base 12*b*. The pillow 20*b* has a surface which is elevated higher than the body support 18*b*. The pillow 20*b* and the body support 18*b* are for supporting the head and body of an infant lying supine on the cushion 10*b*.

The base 12*b* includes an area which defines a boundary 22*b* around the body support 18*b* and the pillow 20*b*. A side wall 24*b* is attached to the periphery of the base 12*b* at the boundary 22*b*. The side wall 24*b* is a tube-shaped cushion. The side wall 24*b* has a surface which is elevated higher than the pillow 20*b* and the body support 18*b*. The boundary 22*b* extends between both the side wall 24*b* and the body support 18*b* and between the side wall 24*b* and the pillow 20*b*.

A removable ring-shaped cushion insert 26*b* is for location on the boundary 22*b*. The ring insert 26*b* is identical to the side wall 24*b*. The ring insert 26*b*, when placed on the boundary 22*b*, reduces the surface area of the base 12*b* on which the infant can lie (FIG. 5*a*).

A pair of handles 28*b*, 30*b* (FIG. 5) are non-releasably attached to the side wall 24*b* at opposite ends of the cushion 10*b*. The handles 28*b*, 30*b* are for transporting the cushion 10*b*. In the embodiment according to FIG. 5, one handle 28*b* is located on the side wall 24*b* adjacent the pillow 20*b* and the other handle 30*b* is located on the side wall 24*b* adjacent the body support 18*b* where the infant's feet would be located.

In this embodiment, the blanket 32*b* is completely removable and no part of the blanket is non-releasably attached to the side wall 24*b*. The blanket 32*b* is formed into a pocket and slides over the bottom half of the cushion 10*b*. The pocket shape of the blanket 32*b* encircles the cushion 10*b* to engage the bottom surface 16*b* of the base 12*b* and around the bottom half of the side wall 24*b*. Portions 34*b*, 36*b* of the blanket 32*b* and portions 35*b*, 37*b* of the side wall 24*b* are releasably secured together by Velcro™. The blanket 32*b* and the side wall 24*b* have mating portions secured together by Velcro™. The blanket 32*b* can be removed from the cushion 10*b* to wash the blanket separately from the cushion.

Similar to the embodiment shown in FIGS. 1–1*a* and 2–2*a*, the blanket 32*b* extends across the body support 18*b* up to the pillow 20*b* but does not extend over the pillow nor the head of the infant when the infant is placed into the cushion 10*b*and covered by the blanket. The infant cannot pull the blanket 32*b* up over his/her head since it is secured to the side wall 24*b* by Velcro™ and is cut in the form of a pocket to a length which does not extend over the pillow 20*b*.

When placed into the portable infant cushion 10 of the present invention, the infant cannot unconsciously pull up the integral blanket 32 over its head. In addition, the infant cannot or roll underneath the integral pillow 20. The cushion 10 helps to prevent the infant from suffocating on the blanket or the pillow. Also, the blanket 32 cannot be pulled off of the infant to uncover the infant which can help to inhibit the infant from catching a cold.

Figure 6A:
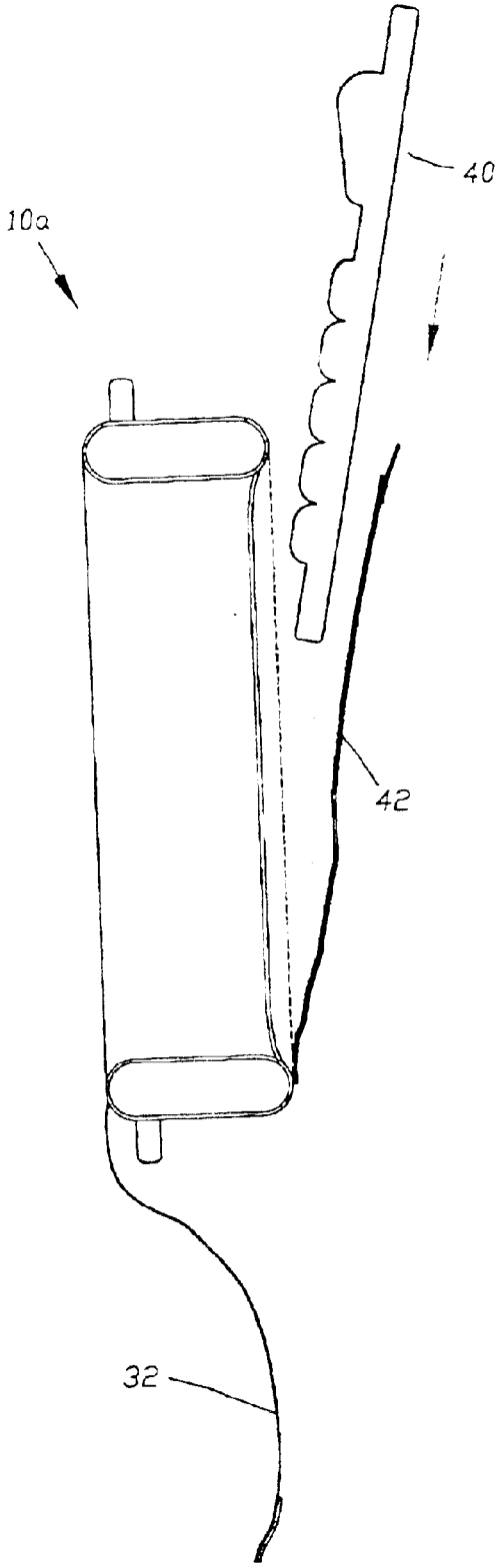
FIG. 6*a* is a cross-sectional view of the portable infant cushion taken along the lines 6*a*—6*a* of FIG. 6.
Figure 6:
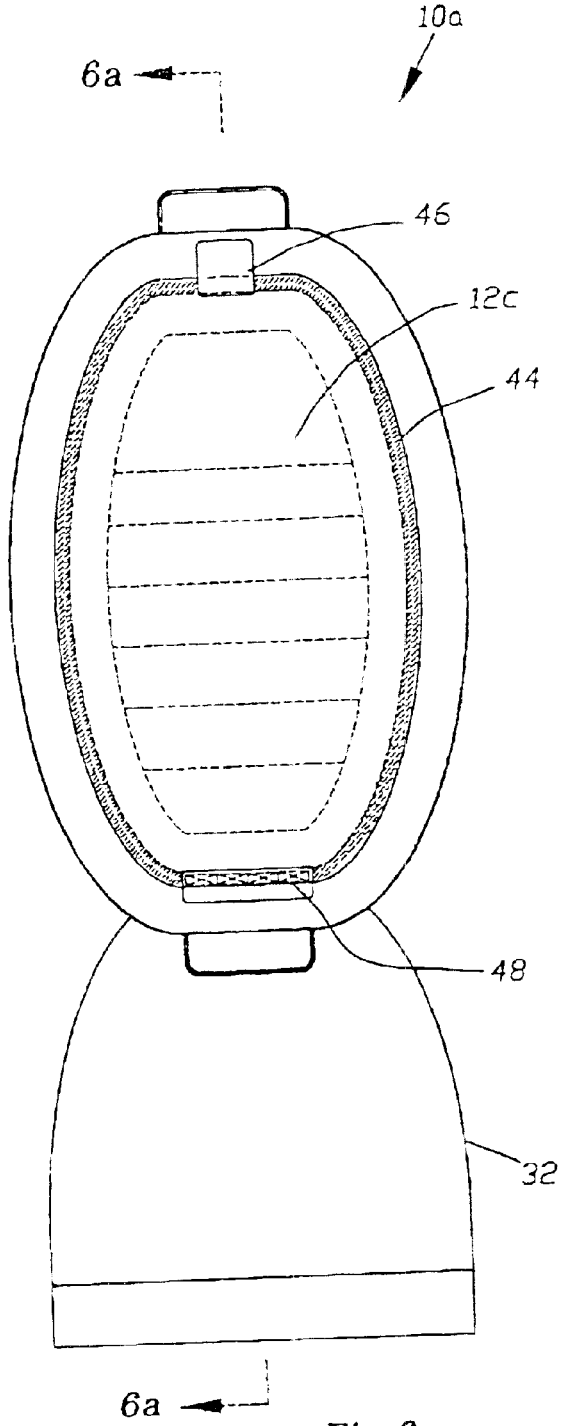
FIG. 6 is a schematic bottom view of a portable infant cushion according to a fourth embodiment with parts removed for clarity.

FIGS. 6–6*a* illustrate a fourth embodiment of the portable infant cushion. The cushion 10*c* is similar to the cushion 10 and parts that are the same or similar are given the same reference numerals with the suffix "c" attached. The infant cushion 10*c* has a generally oval shape.

The infant cushion 10*c* has a planar base 12*c* made of a one-piece layer of cushion material 40 inserted into a pocket 42. The pocket 42 has a Velcro™ or zipper closure 44 extending around the perimeter of the cushion 10*c*. A fabric tab 46 is attached to the zipper or Velcro™ closure 44 and is also releasably attached to the base 12*c* of the cushion 10*c*. The tab 46 facilitates opening the closure 44. It may be desirable to open the closure 44 to remove the cushion material 40, for example, for washing the cushion 10*c*. The pocket 42 is not completely removable from the cushion 10*c* because it is permanently attached to the base 12*c* at least at one section 48.

The cushion material 40 of this embodiment functions as the pillow 20 and body support 18 in the embodiment of FIG. 1 and can be manufactured of the same materials as the pillow 20 and body support 18. The particular thickness of the cushion material 40 can vary according to the manufacturer's preferences for achieving a desired degree of cushioning. In a particular example, the thickness of the cushion material 40 can be, but is not limited to, between 1–4 inches.

Figure 7C:
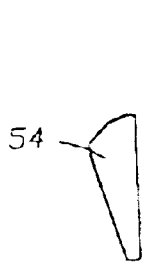
FIG. 7*c* is a cross-sectional view of a portion of the portable infant cushion taken along the lines 7*c*—7*c* of FIG. 7*b*.
Figure 7B:
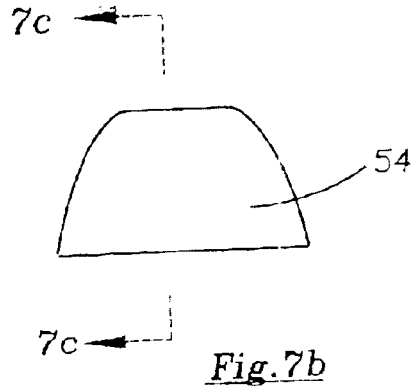
FIG. 7*b* is a schematic plan view of a portion of the portable infant cushion of FIG. 7*a*.
Figure 7A:
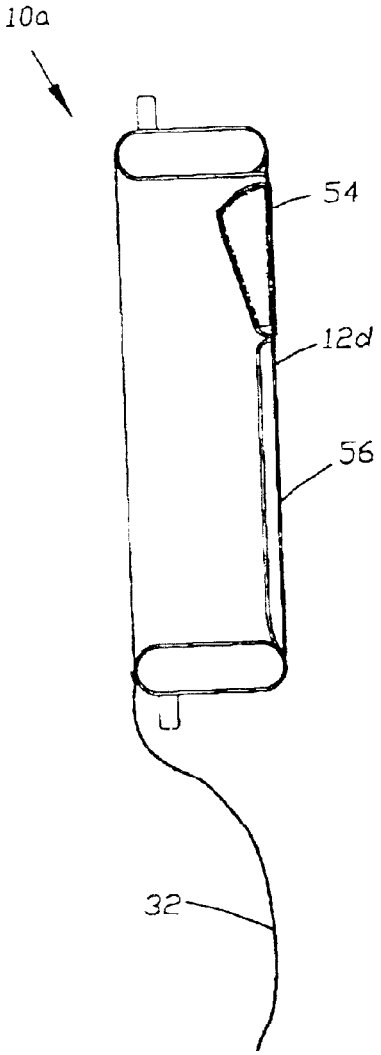
FIG. 7*a* is a cross-sectional view of the portable infant cushion taken along the lines 7*a*—7*a* of FIG. 7.
Figure 7:
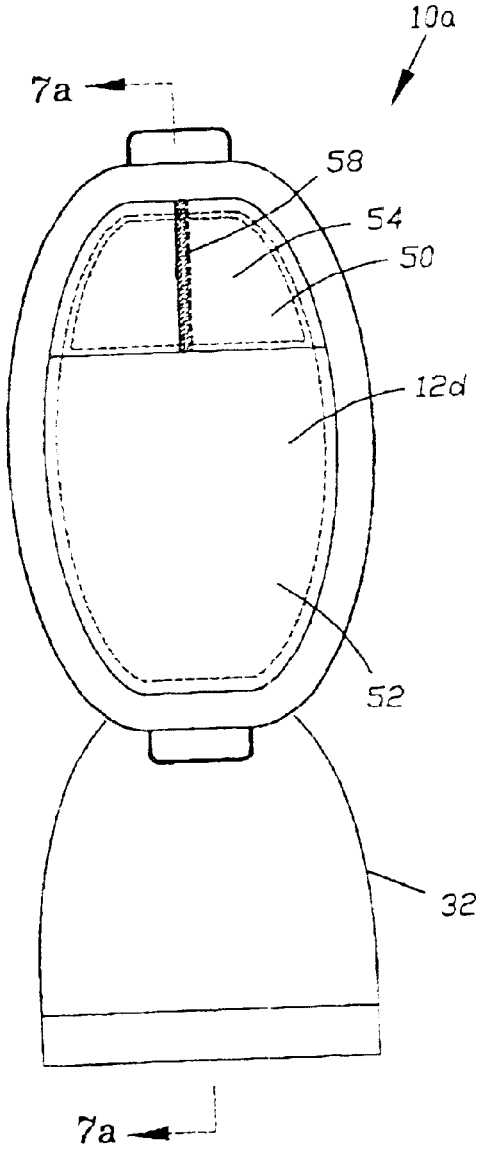
FIG. 7 is a schematic bottom view of a portable infant cushion according to a fifth embodiment with parts removed for clarity.

FIGS. 7–7*a* illustrate a fifth embodiment of the portable infant cushion. The cushion 10*d* is similar to the cushion 10 and parts that are the same or similar are given the same reference numerals with the suffix "d" attached. The infant cushion 10*d* has a generally oval shape.

The infant cushion 10*d* has a planar base 12*d*. The base 12*d* consists of two separate pockets 50, 52. The pocket 50 is for containing a layer of cushion material 54. The cushion material 54 functions as a pillow 20 similar to the embodiment of FIG. 1.

As viewed in FIG. 7, the pocket 50 has a longitudinally extending Velcro™ or zipper closure 58. The closure 58 extends along the middle of the pocket 50. However, the closure 58 can have any suitable location along the pocket 58 which facilitates removal and insertion of the cushion 54. In the embodiment of FIG. 7, the cushion material 54 is removable from the pocket 50 through the closure 58, for example, for washing the cushion 10*d*.

The cushion 54 is a preformed structure having a surface elevated and angled relative to the base 12*d* and having a shape generally conforming to the dimensions of the pocket 50. The cushion material 54 can have thickness which varies depending on the manufacturer's specifications. In one particular embodiment, the cushion material 54 can be, but is not limited to, between 1–4 inches thick.

The pocket 52 contains a separate layer of cushion material 56. Unlike the cushion material 54, the cushion material 56 is not removable from pocket 52. The cushion material 56 functions as a body support 18 similar to the embodiment of FIG. 1. The cushion material 54 and 56 can be manufactured from the same materials as the pillow 20 and the body support 18 similar to the embodiment of FIG. 1.

Although the cushion 10 is shown for insertion into a bassinet 100 in FIG. 3, the portable infant cushion can be advantageously inserted horizontally in a crib (not show) to provide a secure cushioned surrounding in which the infant cannot roll out of the cushion and into the crib slots. Instead of a crib, the portable infant cushion 10 can also be placed onto the floor, on top of an adult bed, into a stroller, baby buggy or car seat (not shown).

Another advantage of the portable infant cushion 10 of the present invention is that the ring insert 26 can be removed to vary the surface area of the top surface 14 on the base 12. Thus, the ring insert 26 enables the cushion 10 to adapt in size as the infant grows and enables the cushion to retain its usefulness as the infant grows.

Another advantage of the portable infant cushion 10 is that it provides the infant with emotional security and comfort. Infants naturally prefer to snuggle up to surfaces for physical support and for emotional security and warmth rather than be isolated and unsupported by any surface. The infant can sleep better and have a better disposition because the infant is well supported and comfortable in the portable infant cushion 10.

From the above description of the invention, those skilled in the art will perceive improvements, changes and modifications. For example, although the portable infant cushion 10 is illustrated as an oval shape, other shapes are contemplated such as square, circular or rectangular. In addition, although the blanket 32 is illustrated as a half oval, the blanket can have a square or rectangle shape. Further, although the handles 28, 30 are illustrated as one handle located at each of the opposite longitudinal ends of the side wall 24, other locations of the handles around the side wall are contemplated. In addition, a portable infant cushion having no handles is also contemplated. A cushion without handles is portable merely by securely grasping the bottom or side wall of the cushion. Such improvements, changes and modifications within the skill of the art are intended to be covered by the appended claims.

What is claimed is:

1. A portable infant cushion comprising:

a base having a top surface for engaging the body of an infant placed onto said top surface and for transferring the weight of the infant;

said top surface including a head support portion non-releasably attached to said base and for supporting the head of the infant;

said top surface including a body support portion connected to said base and longitudinally spaced from said head support portion and for supporting the body of the infant;

said head support portion having a head engaging surface elevated relative to said body support portion;

a side wall connected to said base, said side wall extending peripherally around said base and having an elevated surface elevated relative to said base higher than said head support portion;

a blanket for covering the infant adapted to be placed on said top surface, said blanket having at least a portion secured to said side wall, said blanket being extensible over said top surface without extending over said head support portion, wherein said base includes an area defining a boundary around said body support portion and said pillow and wherein said side wall is connected to said base at said boundary and said boundary extends between both of said side wall and said body support portion as well as said side wall and said head support portion, and a removable ring insert for placement on said boundary and for engaging an inner area of said side wall and for reducing the top surface of said base available for the infant adapted to be placed on said top surface to engage.

2. The portable infant cushion according to claim 1 wherein said side wall is a unitary ring structure.

3. The portable infant cushion according to claim 2 wherein said ring insert is a unitary ring structure identical to said side wall.

4. The portable infant cushion according to claim 1 wherein said base, said side wall and said insert ring are resilient structures made of French terry cloth material filled with batting.

5. A portable infant cushion comprising:

a base having a top surface for engaging the body of an infant placed onto said too surface and for transferring the weight of the infant;

said base having a pocket;

a layer of cushion material for insertion into said pocket, said layer of cushion material having a head support portion which includes a surface elevated relative to said base for supporting the head of the infant;

said layer of cushion material having a body support portion longitudinally spaced from said head support portion for supporting the body of the infant;

a side wall connected to said base, said side wall extending peripherally around said base and having an elevated surface elevated relative to said base higher than said head support portion; and a blanket for covering the infant adapted to be placed on said top surface, said blanket having at least a portion secured to said side wall, said blanket being extensible over said top surface without extending over said head support portion.

6. The portable infant cushion according to claim 5 wherein said pocket includes a closure connected to and extending around the perimeter of said cushion, said closure being opened to remove said layer of cushion material from said pocket, said closure being closed after insertion of said layer of cushion material into said pocket.

7. The portable infant cushion according to claim 5 wherein said closure includes a tab for opening and closing said closure.

8. The portable infant cushion according to claim 5 wherein said at least a portion of said blanket is non-releasably secured to said side wall.

9. The portable infant cushion according to claim 5 wherein said at least a portion of said blanket is releasably secured to said side wall.

10. A portable infant cushion comprising:

a base having a top surface for engaging the body of an infant placed onto said top surface and for transferring the weight of the infant;

said base including first and second pockets;

said first pocket containing a first layer of cushion material, said second pocket containing a second layer of cushion material;

said first layer of cushion material having a surface elevated relative to said base for supporting the head of the infant placed onto said top surface;

said second layer of cushion material being located longitudinally spaced from said first layer of cushion material and being for supporting the body of the infant;

a side wall connected to said base, said side wall extending peripherally around said base and having an elevated surface elevated relative to said base higher than said surface of said first layer of cushion material; and a blanket for covering the infant adapted to be placed on said top surface, said blanket having at least a portion secured to said side wall, said blanket being extensible over said top surface without extending over said first layer of cushion material;

said first pocket having a closure, said closure being opened to remove said first layer of cushion material from said first pocket, said closure being closed after insertion of said first layer of cushion material into said first pocket.

11. The portable infant cushion according to claim 10 wherein said at least a portion of said blanket is non-releasably secured to said side wall.

12. The portable infant cushion according to claim 10 wherein said at least a portion of said blanket is releasably secured to said side wall.

13. Apparatus comprising: an infant bassinet and a portable infant cushion for insertion in said infant bassinet, said infant bassinet comprising:

a bed portion and a barrier portion extending around the perimeter of the bed portion, said cushion comprising:

a base with a top surface for engaging and supporting an infant adapted to be placed on said top surface and a bottom surface located opposite said top surface and which does not engage the body of the infant;

said top surface including a head support portion non-releasably secured to said base and having a head engaging surface elevated relative to said base for supporting the head of the infant;

a side wall connected to said base, said side wall being peripherally located and having an elevated surface elevated relative to said base higher than said head support portion;

a blanket for covering the infant adapted to be placed on said top surface, said blanket having at least a portion secured to said side wall, said blanket being extensible over said top surface without extending over the head support portion;

said bottom surface engaging said bed portion of the infant bassinet and said side wall engaging the barrier portion of said infant bassinet to cover the bed portion and to reduce the space available on the bed portion to accommodate the infant.

14. The apparatus according to claim 13 wherein said top surface includes a body support portion connected to said base and loagitudinally spaced from said head support for supporting the body of an infant.

15. The apparatus according to claim 13 further comprising handles attached to said sidewall for transporting said cushion.

16. The apparatus according to claim 13 further comprising a removable ring insert for placement on said base and for engaging an inner area of said side wall and for reducing the top surface of said base available for the infant adapted to be placed on said top surface to engage.

17. The apparatus according to claim 13 wherein said at least a portion of said blanket is non-releasably secured to said side wall.

18. The apparatus according to claim 13 wherein said at least a portion of said blanket is releasably secured to said side wall.

* * * * *

UNITED STATES PATENT AND TRADEMARK OFFICE

CERTIFICATE OF CORRECTION

PATENT NO. : 6,848,128 B2
DATED : February 1, 2005
INVENTOR(S) : Esther A. L. Verbovszky and Carl Myers It is certified that error appears in the above-identified patent and that said Letters Patent is hereby corrected as shown below:

Column 8,
Line 61, after "said" change "too" to -- top --.

Column 10,
Line 40, after "and" change "loagitudinally" to -- longitudinally --.

Signed and Sealed this

Twenty-fourth Day of May, 2005

JON W. DUDAS
*Director of the United States Patent and Trademark Office*